US011421707B2

(12) United States Patent
Lyons

(10) Patent No.: US 11,421,707 B2
(45) Date of Patent: Aug. 23, 2022

(54) BLOWER HOUSING HAVING INTEGRAL EXHAUST BLOWER DISCHARGE DRAIN SECTION

(71) Applicant: Regal Beloit America, Inc., Beloit, WI (US)

(72) Inventor: Leslie A. Lyons, Cassville, MO (US)

(73) Assignee: Regal Beloit America, Inc., Beloit, WI (US)

( * ) Notice: Subject to any disclaimer, the term of this patent is extended or adjusted under 35 U.S.C. 154(b) by 0 days.

(21) Appl. No.: 17/315,656

(22) Filed: May 10, 2021

(65) Prior Publication Data

US 2021/0262486 A1 Aug. 26, 2021

Related U.S. Application Data

(63) Continuation of application No. 17/166,732, filed on Feb. 3, 2021, now Pat. No. 11,009,037, which is a continuation of application No. 16/502,475, filed on Jul. 3, 2019, now abandoned, which is a continuation of application No. 14/194,099, filed on Feb. 28, 2014, now abandoned.

(51) Int. Cl.
*F04D 29/42* (2006.01)
*F04D 29/70* (2006.01)

(52) U.S. Cl.
CPC ..... *F04D 29/4226* (2013.01); *F04D 29/706* (2013.01)

(58) Field of Classification Search
CPC ..... F04D 29/4226; F04D 29/4233; F04D 29/701; F04D 29/706
See application file for complete search history.

(56) References Cited

U.S. PATENT DOCUMENTS

| | | | | |
|---|---|---|---|---|
| 6,494,152 | B2 * | 12/2002 | Gatley, Jr. ..... | F01D 25/24 415/206 |
| 6,511,288 | B1 | 1/2003 | Gatley, Jr. | |
| 6,511,290 | B1 | 1/2003 | Gatley, Jr. | |
| 6,536,378 | B2 | 3/2003 | Lyons | |
| 6,801,406 | B2 | 10/2004 | Komatsu et al. | |
| 7,182,574 | B2 | 2/2007 | Lyons | |
| 7,210,903 | B2 | 5/2007 | Lyons | |
| 7,861,708 | B1 | 1/2011 | Lyons | |

* cited by examiner

*Primary Examiner* — Michael L Sehn
(74) *Attorney, Agent, or Firm* — Thompson Coburn LLP

(57) ABSTRACT

A blower housing comprises first and second blower housing pieces for surrounding a blower fan. The first blower housing piece comprises a blower discharge section comprising an inner tubular portion, an outer tubular portion, and a drain hole. The inner tubular portion defines a blower discharge passage. The inner and outer tubular portions define an exhaust pipe cavity adapted to receive an end margin of an exhaust pipe. The tubular portions are adapted to enable condensate water that forms on the inner surface of the exhaust pipe to flow into the exhaust pipe cavity. The drain hole extends through the outer tubular portion. The drain hole is configured to enable condensate water flowing into the exhaust pipe cavity to drain from the blower housing. The first blower housing piece is a molded one-piece member.

18 Claims, 5 Drawing Sheets

BLOWER HOUSING HAVING INTEGRAL EXHAUST BLOWER DISCHARGE DRAIN SECTION

CROSS-REFERENCE TO RELATED APPLICATIONS

This application is a continuation of U.S. application Ser. No. 17/166,732, filed Feb. 3, 2021, issued as U.S. Pat. No. 11,009,037, on May 18, 2021, which is a continuation of U.S. application Ser. No. 16/502,475, filed Jul. 3, 2019, now abandoned, which is a continuation of U.S. application Ser. No. 14/194,099, filed Feb. 28, 2014, now abandoned, the disclosures of which are incorporated herein by reference.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to blower housings.

SUMMARY OF THE INVENTION

One aspect of the present invention is a blower housing comprising a first blower housing piece and a second blower housing piece. The first and second blower housing pieces are adapted and configured to be connected to one another in a manner to collectively surround a blower fan. The first blower housing piece comprises a blower discharge section adapted to be coupled to an exhaust pipe. The blower discharge section comprises an inner tubular portion, an outer tubular portion, and at least one drain hole. The inner tubular portion has an inner surface and an outer surface. The inner surface of the inner tubular portion defines a blower discharge passage. The outer tubular portion surrounds the inner tubular portion. The outer tubular portion has an inner surface and an outer surface. The inner surface of the outer tubular portion and the outer surface of the inner tubular portion are spaced sufficiently apart to define an exhaust pipe cavity. The exhaust pipe cavity is adapted to receive an end margin of the exhaust pipe to enable the end margin of the exhaust pipe to be positioned between the inner tubular portion and the outer tubular portion. The inner tubular portion and the outer tubular portion are adapted and configured to enable condensate water that forms on the inner surface of the exhaust pipe to flow into the exhaust pipe cavity. The at least one drain hole extends through the outer tubular portion and is in fluid communication with the exhaust pipe cavity. The at least one drain hole is adapted and configured to enable condensate water flowing into the exhaust pipe cavity to drain from the blower housing via the at least one drain hole. The first blower housing piece is a molded one-piece member.

Figure 1:
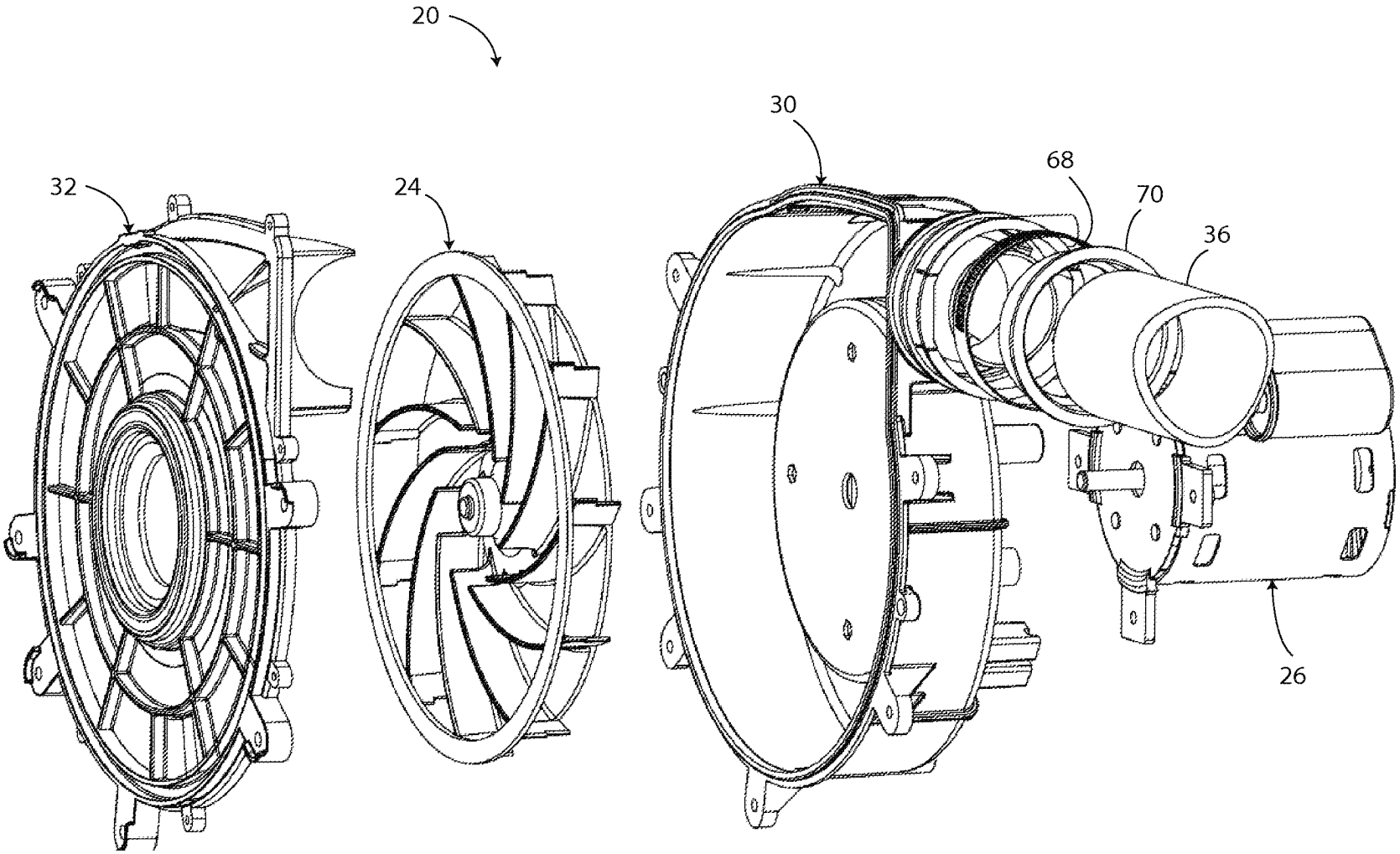
FIG. 1 is an exploded perspective view of an embodiment of a blower of the present invention and an exhaust pipe, the blower comprising a blower housing, a fan, and a motor.
Figure 2:
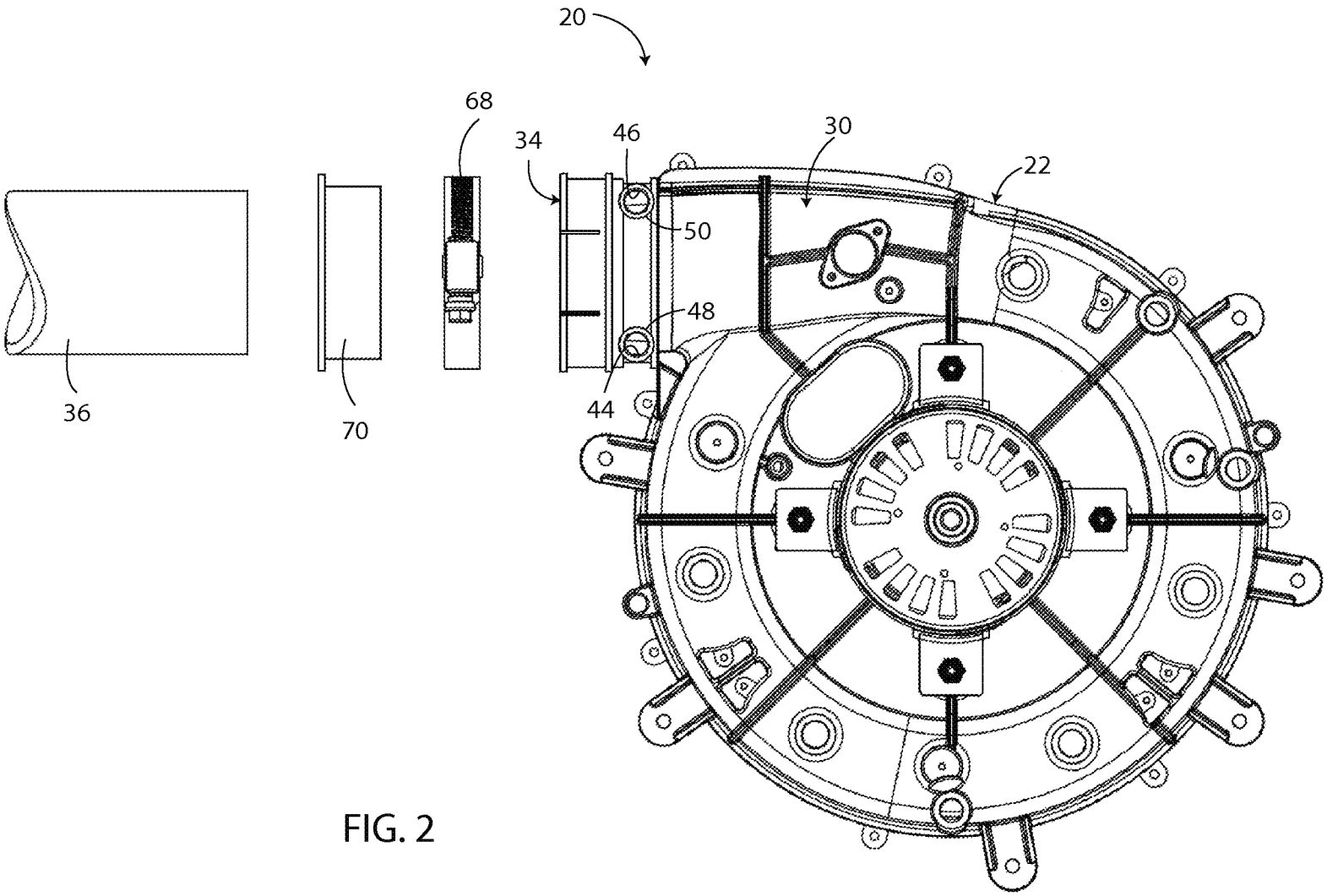
FIG. 2 is an exploded side elevational view of the blower of FIG. 1, with the exhaust pipe separated from the blower.

Reference numerals in the written specification and in the drawing figures indicate corresponding items.

DETAILED DESCRIPTION

An embodiment of a blower of the present invention is indicated generally by reference numeral 20 in FIG. 1. The blower 20 comprises a blower housing 22, a blower fan 24, and a motor 26 configured to rotate the blower fan. The blower housing 22 has a first blower housing piece 30 and a second blower housing piece 32. The first and second blower housing pieces 30, 32 are adapted and configured to be connected to one another in a manner to collectively surround the blower fan 24. The first blower housing piece 30 comprises a blower discharge section 34 adapted to be coupled to an exhaust pipe 36. The blower discharge section 34 comprises an inner tubular portion 40, an outer tubular portion 42, and first and second drain holes 44, 46. In the present embodiment, the blower discharge section 34 of the first blower housing piece 30 further includes first and second drain tubes 48, 50 protruding from the outer tubular portion 42. The first drain tube 48 is in fluid communication with the first drain hole 44. The second drain tube 50 is in fluid communication with the second drain hole 46.

Figure 4:
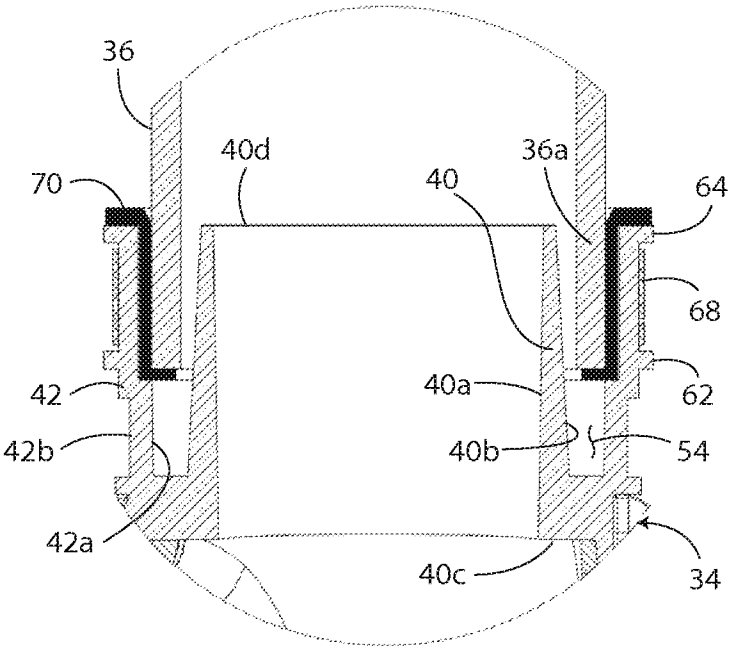
FIG. 4 is an enlarged fragmented, section view of the blower discharge section of the blower of FIGS. 1-3.

The inner tubular portion 40 has an inner surface 40*a* and an outer surface 40*b*. The inner surface 40*a* of the inner tubular portion 40 defines a blower discharge passage. The outer tubular portion 42 surrounds the inner tubular portion 40. Referring to FIG. 4, the inner tubular portion 40 extends longitudinally generally from an upstream end 40*c* to a downstream end 40*d*. The outer surface 40*b* of the inner tubular portion 40 tapers radially inwardly toward the downstream end 40*d* of the inner tubular portion.

Figure 3:
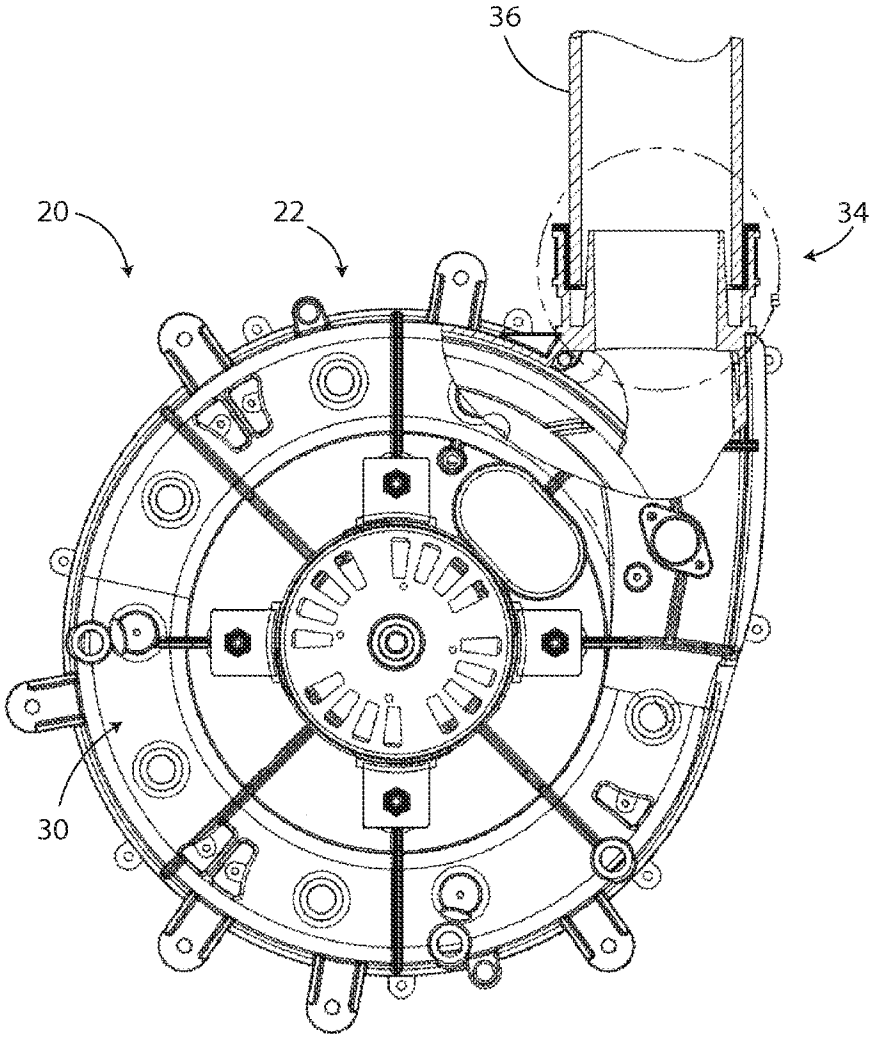
FIG. 3 is a side elevational view of the blower of FIGS. 1 and 2, with portions broken away to show a blower discharge section of the blower housing.
Figure 5:
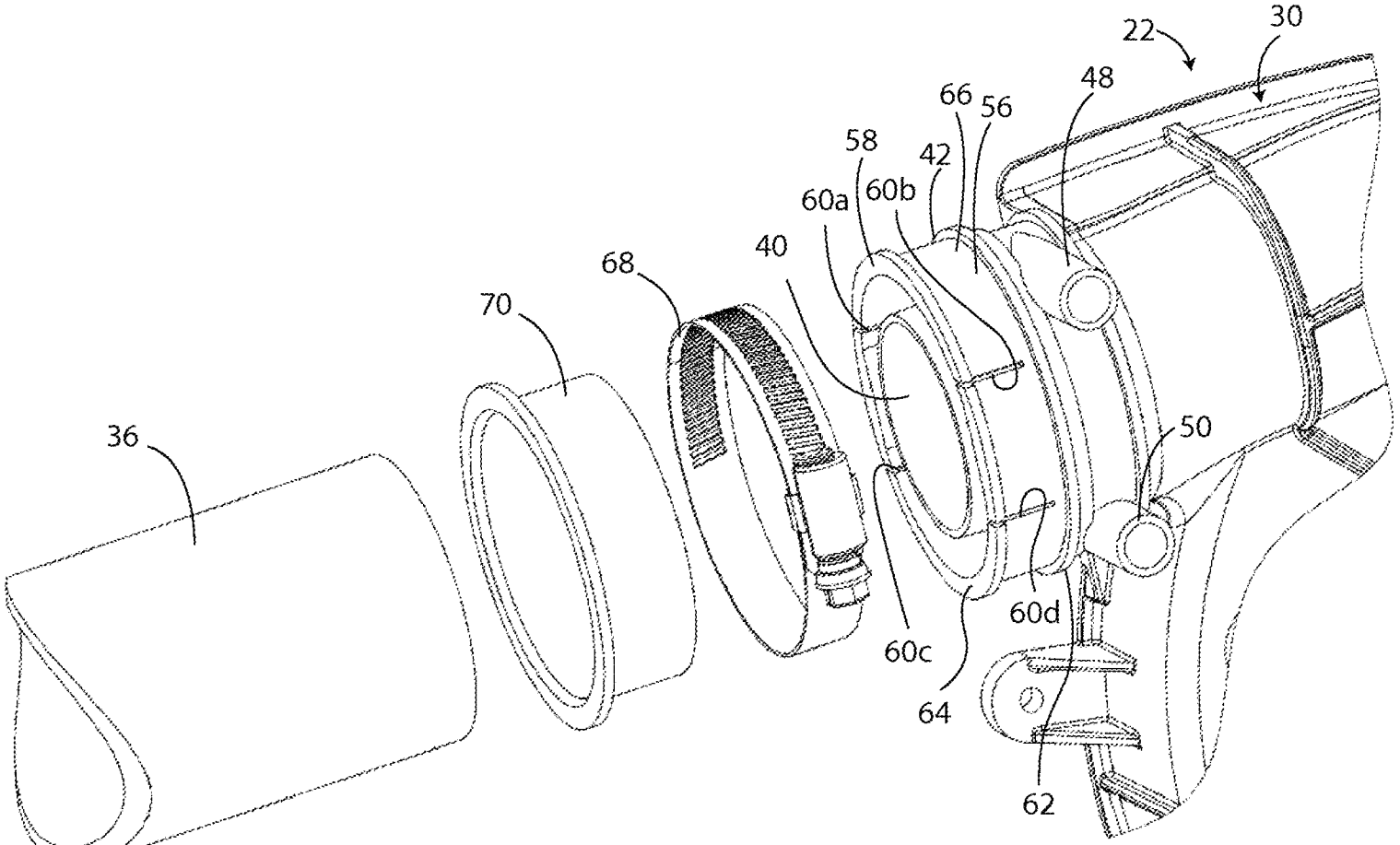
FIG. 5 is an enlarged fragmented, exploded, perspective view of the blower discharge section of the blower of FIGS. 1-4 and the exhaust pipe.

The outer tubular portion 42 has an inner surface 42*a* and an outer surface 42*b*. The inner surface 42*a* of the outer tubular portion 42 and the outer surface 42*b* of the inner tubular portion 42 are spaced sufficiently apart to define an exhaust pipe cavity 54. As shown in FIGS. 3 and 4, the exhaust pipe cavity 54 is adapted to receive an end margin 36*a* of the exhaust pipe 36 to enable the end margin of the exhaust pipe to be positioned between the inner tubular portion 40 and the outer tubular portion 42. The inner tubular portion 40 and the outer tubular portion 42 are adapted and configured to enable condensate water that forms on the inner surface of the exhaust pipe 36 to flow into the exhaust pipe cavity 54. As shown in FIG. 4, in the present embodiment, the outer surface 40*b* of the inner tubular portion is spaced radially inwardly of the inner surface of the exhaust pipe 36 such that condensate water can flow between the inner tubular portion and the exhaust pipe and into the exhaust pipe cavity 54. The first and second drain holes 44, 46 extend through the outer tubular portion 42 and are in fluid communication with the exhaust pipe cavity. Each of the first and second drain holes 44, 46 is adapted and configured to enable condensate water flowing into the exhaust pipe cavity 54 to drain from the blower housing 22 via such drain hole and its corresponding drain tube 48 or 50.

The first blower housing piece 30 is a molded one-piece member. The blower discharge section 34 may be formed at the same time and of the same material as the rest of the first blower housing piece 30. Alternatively, the blower discharge section 34 and the rest of the first blower housing piece 30 may be formed by an over-molding process such that the blower discharge section is of a less rigid material than the rest of the first blower housing piece.

The outer tubular portion 42 includes an axially-extending, downstream end margin 56 adapted and configured to be clamped onto the exhaust pipe 36. The downstream end margin 56 of the outer tubular portion 42 includes a downstream end 58 and a plurality of slits 60*a*, 60*b*, 60*c*, 60*d*. Each slit 60*a*, 60*b*, 60*c*, 60*d* extends axially inwardly from the downstream end 58 of the outer tubular portion 42. The slits 60*a*, 60*b*, 60*c*, 60*d* enable at least one section of the outer tubular portion 42 to resiliently move radially such that the at least one section may be squeezed radially inwardly against the exhaust pipe 36. The downstream end margin 56 of the outer tubular portion 42 includes a pair of annular rings 62, 64 protruding from the outer surface 42*b* of the outer tubular portion 42. The annular rings 62, 64 are axially spaced from one another to define a clamp groove 66 therebetween for receiving a clamp 68. The exhaust pipe 36 may include a cup 70 of a relatively soft polymeric material fitted over the main portion of the exhaust pipe. The cup 70 creates a leak proof seal when clamped to prevent leakage between the inner surface 42*a* of the outer tubular portion and the exhaust pipe 36.

The slits 60*a*, 60*b* comprise a first pair of aligned slits and slits 60*c*, 60*d* comprise a second pair of aligned slits. The first drain hole 44 is circumferentially between the slits of the first pair of aligned slits 60*a*, 60*b*, and the second drain hole is circumferentially between the slits of the second pair of aligned slits 60*c*, 60*d*. In the present embodiment, the second pair of aligned slits 60*c*, 60*d* is generally parallel to the first pair of aligned slits 60*a*, 60*b*. The inner surface 42*a* of the outer tubular portion 42 subtends a first circumferential arc between the slits of the first pair of slits 60*a*, 60*b*, and subtends a second circumferential arc between the slits of the second pair of slits 60*c*, 60*d*. Each of the first and second circumferential arcs is devoid of slits through which water can pass radially through the outer tubular portion 42. Each of the first and second circumferential arcs is preferably at least 75°, and more preferably at least 90°. In the present embodiment, the slits of the first pair of slits 60*a*, 60*b* are collinear, the slits of the second pair of slits 60*c*, 60*d* are collinear, and the slits of the second pair of slits are parallel to the slits of the first pair of slits.

Figure 7:
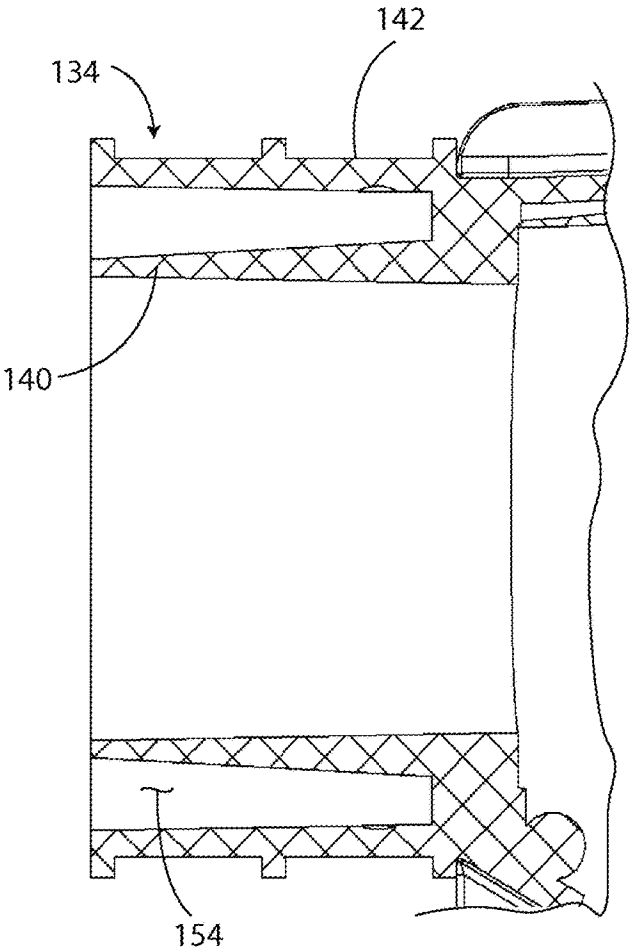
FIG. 7 is a cross-sectional view, taken along the plane of line 7-7 of FIG. 6.
Figure 6:
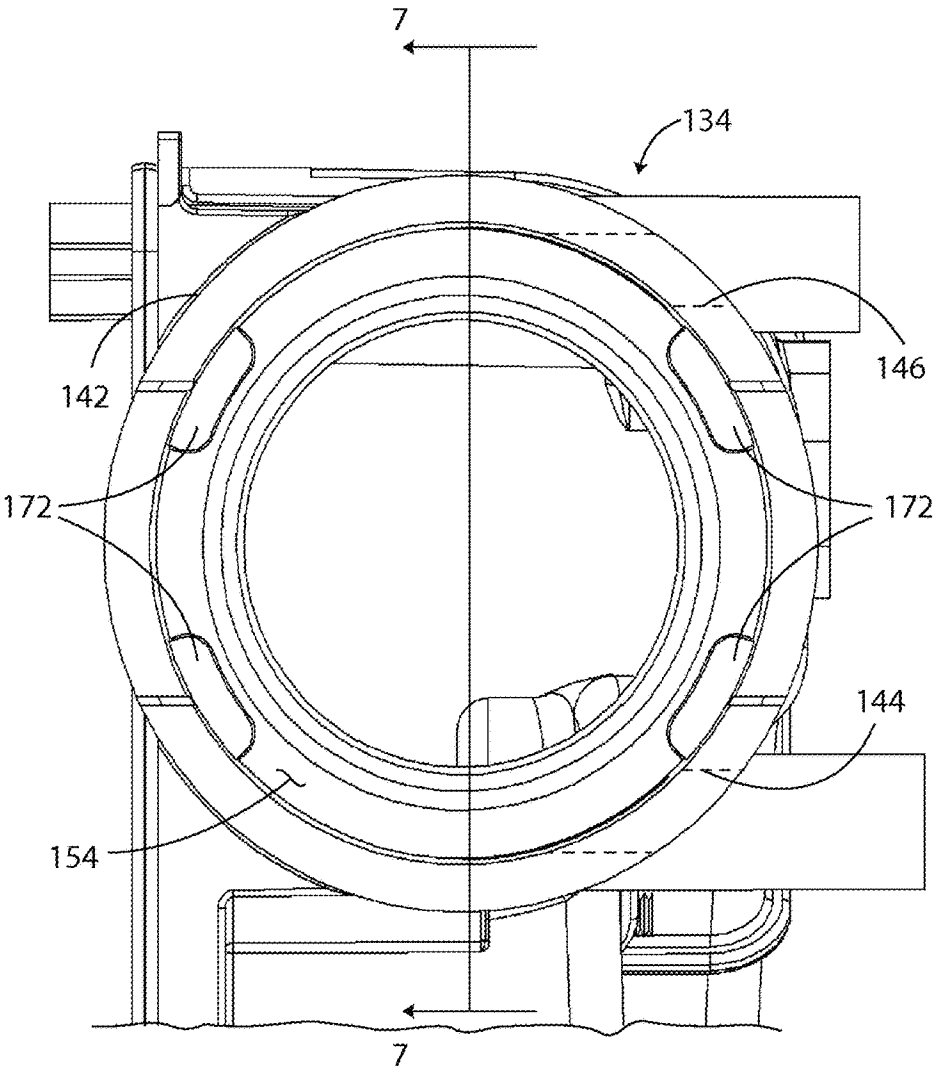
FIG. 6 is a fragmented end view of a blower discharge section of a second embodiment of a blower of the present invention.

Another embodiment of a blower discharge section is indicated by reference number 134 in FIGS. 6 and 7. The blower discharge section 134 of FIGS. 6 and 7 is the same as the blower discharge section 34 of FIGS. 1-5 except for the differences noted herein or apparent from the drawing figures. Thus, except for these differences, the description above with respect to the blower discharge section 34 and its relationship to the other portions of the blower 20 are equally applicable to the blower discharge section 134. The blower discharge section 134 includes an inner tubular portion 140 and an outer tubular portion 142. The inner tubular portion and the outer tubular portion define an exhaust pipe cavity 154. Unlike the outer tubular portion 42, the outer tubular portion 142 does not include a circumferential shoulder for engaging exhaust pipe (or cup of the exhaust pipe). Instead the blower discharge section 134 at least one boss 172 (four of which are shown in FIG. 6) protruding into the exhaust pipe cavity 154. The bosses 172 are in a location and of a size sufficient to prevent the exhaust pipe from being inserted sufficiently deep into the pipe cavity 154 to plug the drain holes 144, 146.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

It should also be understood that when introducing elements of the present invention in the claims or in the above description of exemplary embodiments of the invention, the terms "comprising," "including," and "having" are intended to be open-ended and mean that there may be additional elements other than the listed elements. Additionally, each of the terms "portion" and "section" should be construed as meaning some or all of the item or element that it qualifies. Moreover, use of identifiers such as first, second, and third should not be construed in a manner imposing any relative position or time sequence between limitations. Still further, the order in which the steps of any method claim that follows are presented should not be construed in a manner limiting the order in which such steps must be performed.

What is claimed is:

1. A blower housing comprising a first blower housing piece and a second blower housing piece, the first and second blower housing pieces being adapted and configured to be connected to one another in a manner to collectively surround a blower fan, at least one of the first and second blower housing pieces defining a wall of the blower housing extending around a radial periphery of the blower fan, the first blower housing piece comprising a blower discharge section adapted to be coupled to an exhaust pipe, the blower discharge section comprising:

an inner tubular portion and an outer tubular portion, the inner tubular portion having an inner surface and an outer surface, the inner surface of the inner tubular portion defining a blower discharge passage, the outer tubular portion surrounding the inner tubular portion, the outer tubular portion having an inner surface and an outer surface, the inner surface of the outer tubular portion and the outer surface of the inner tubular portion being spaced sufficiently apart to define an exhaust pipe cavity, the exhaust pipe cavity being adapted to receive an end margin of the exhaust pipe to enable the end margin of the exhaust pipe to be positioned between the inner tubular portion and the outer tubular portion, the inner tubular portion and the outer tubular portion being adapted and configured to enable condensate water that forms on the inner surface of the exhaust pipe to flow into the exhaust pipe cavity;

at least one drain hole extending through the outer tubular portion and in fluid communication with the exhaust pipe cavity, the at least one drain hole being adapted and configured to enable condensate water flowing into the exhaust pipe cavity to drain from the blower housing via the at least one drain hole;

the first blower housing piece being a one-piece member;

the inner tubular portion extending longitudinally from an upstream end to a downstream end, the inner tubular portion upstream end being in a plane that intersects the wall of the blower housing.

2. The blower housing as set forth in claim 1 wherein the outer tubular portion includes an axially extending, downstream end margin adapted and configured to be clamped onto the exhaust pipe.

3. The blower housing as set forth in claim 1 wherein the outer surface of the inner tubular portion tapers radially inwardly toward the downstream end.

4. The blower housing as set forth in claim 1 wherein the outer tubular portion extends longitudinally from an upstream end to a downstream end, the inner tubular portion downstream end terminates at the outer tubular portion downstream end.

5. The blower housing as set forth in claim 1 wherein the blower discharge section of the first blower housing piece further includes at least one boss protruding into the exhaust pipe cavity, the boss being in a location and of a size sufficient to prevent the exhaust pipe from plugging the at least one drain hole.

6. The blower housing as set forth in claim 1 wherein the at least one drain hole comprises first and second drain holes.

7. The blower housing as set forth in claim 1 wherein the at least one drain hole comprises first and second drain holes, and wherein the blower discharge section of the first blower housing piece further includes first and second drain tubes protruding from the outer tubular portion, the first drain tube being in fluid communication with the first drain hole, and the second drain tube being in fluid communication with the second drain hole.

8. The blower housing as set forth in claim 1 further comprising a cup positioned to extend within the exhaust pipe cavity and be secured by the outer tubular portion, the cup configured to form a seal between the inner surface of the outer tubular portion and the exhaust pipe.

9. The blower housing as set forth in claim 1 wherein the blower discharge section is formed of the same material as the rest of the first blower housing piece.

10. The blower housing as set forth in claim 1 wherein the second blower housing piece has a plurality of mounting feet projecting radially outward from the second blower housing piece, the outer and inner tubular portions extend axially along an axis, the at least one drain hole is positioned such that a further plane perpendicular to the axis and intersecting the at least one drain hole, also intersects at least one of the mounting feet of the second blower housing piece.

11. A blower housing comprising a first blower housing piece and a second blower housing piece, the first and second blower housing pieces being adapted and configured to be connected to one another in a manner to collectively surround a blower fan, the first blower housing piece defining a wall of the blower housing extending around a radial periphery of the blower fan, the first blower housing piece comprising a blower discharge section adapted to be coupled to an exhaust pipe, the second blower housing piece defining a bottom side of the blower housing, the blower discharge section comprising:

an inner tubular portion and an outer tubular portion, the inner tubular portion having an inner surface and an outer surface, the inner surface of the inner tubular portion defining a blower discharge passage, the outer tubular portion surrounding the inner tubular portion, the outer tubular portion having an inner surface and an outer surface, the inner surface of the outer tubular portion and the outer surface of the inner tubular portion being spaced sufficiently apart to define an exhaust pipe cavity, the exhaust pipe cavity being adapted to receive an end margin of the exhaust pipe to enable the end margin of the exhaust pipe to be positioned between the inner tubular portion and the outer tubular portion, the inner tubular portion and the outer tubular portion being adapted and configured to enable condensate water that forms on the inner surface of the exhaust pipe to flow into the exhaust pipe cavity;

at least one drain hole extending through the outer tubular portion and in fluid communication with the exhaust pipe cavity, the at least one drain hole being adapted and configured to enable condensate water flowing into the exhaust pipe cavity to drain from the blower housing via the at least one drain hole;

the first blower housing piece being a one-piece member; and the inner tubular portion extending along an axis from an upstream end to a downstream end, and a plane perpendicular to the axis and intersecting the upstream end of the inner tubular portion also intersects the second blower housing piece.

12. The blower housing as set forth in claim 11 wherein the outer tubular portion extends generally from an upstream end to a downstream end, the inner tubular portion downstream end terminating at the outer tubular portion downstream end.

13. A blower housing comprising a first blower housing piece and a second blower housing piece, the first and second blower housing pieces being adapted and configured to be connected to one another in a manner to collectively surround a blower fan, at least one of the first and second blower housing pieces defining a wall of the blower housing extending around a radial periphery of the blower fan, the first blower housing piece comprising a blower discharge section adapted to be coupled to an exhaust pipe, the blower discharge section comprising:

an inner tubular portion and an outer tubular portion, the inner tubular portion having an inner surface and an outer surface, the inner surface of the inner tubular portion defining a blower discharge passage, the outer tubular portion surrounding the inner tubular portion, the outer tubular portion having an inner surface and an outer surface, the inner surface of the outer tubular portion and the outer surface of the inner tubular portion being spaced sufficiently apart to define an exhaust pipe cavity, the exhaust pipe cavity being adapted to receive an end margin of the exhaust pipe to enable the end margin of the exhaust pipe to be positioned between the inner tubular portion and the outer tubular portion, the inner tubular portion and the outer tubular portion being adapted and configured to enable condensate water that forms on the inner surface of the exhaust pipe to flow into the exhaust pipe cavity;

at least one drain hole extending through the outer tubular portion and in fluid communication with the exhaust pipe cavity, the at least one drain hole being adapted and configured to enable condensate water flowing into the exhaust pipe cavity to drain from the blower housing via the at least one drain hole; and the first blower housing piece being a one-piece member;

the inner and outer tubular portions extending axially along an axis; and the inner and outer tubular portions being arranged such that a plane perpendicular to the axis and intersecting both the inner and outer tubular portions also intersects the second blower housing piece.

14. The blower housing as set forth in claim 13 wherein the inner tubular portion extends longitudinally generally from an upstream end to a downstream end, the outer tubular portion extends generally from an upstream end to a downstream end, the inner tubular portion downstream end terminating within the outer tubular portion downstream end.

15. The blower housing as set forth in claim 13 wherein the blower discharge section is formed of the same material as the rest of the first blower housing piece.

16. The blower housing as set forth in claim 13 wherein the second blower housing piece has a plurality of mounting feet projecting radially outward from the second blower housing piece, the plane perpendicular to the axis and intersecting both the inner and outer tubular portions also intersects at least one of the mounting feet of the second blower housing piece.

17. The blower housing as set forth in claim 13 wherein the at least one drain hole is positioned such that a further plane perpendicular to the axis and intersecting the at least one drain hole also intersects the second blower housing piece.

18. The blower housing as set forth in claim 17 wherein the second blower housing piece has a plurality of mounting feet projecting radially outward from the second blower housing piece, the further plane also intersects at least one of the mounting feet of the second blower housing piece.

* * * * *